US009616308B2

(12) United States Patent
Gilman et al.

(10) Patent No.: US 9,616,308 B2
(45) Date of Patent: Apr. 11, 2017

(54) PRACTICE GOALIE

(71) Applicant: Marty Gilman, Inc., Gilman, CT (US)

(72) Inventors: Neil Gilman, Gilman, CT (US); Craig Wanner, Gilman, CT (US)

(73) Assignee: Marty Gilman, Inc., Gilman, CT (US)

( * ) Notice: Subject to any disclaimer, the term of this patent is extended or adjusted under 35 U.S.C. 154(b) by 86 days.

(21) Appl. No.: 14/593,974

(22) Filed: Jan. 9, 2015

(65) Prior Publication Data

US 2015/0190693 A1 Jul. 9, 2015

Related U.S. Application Data

(60) Provisional application No. 61/925,499, filed on Jan. 9, 2014.

(51) Int. Cl.

| | |
|---|---|
| ***A63B 69/00*** | (2006.01) |
| ***A63B 63/06*** | (2006.01) |
| ***A63B 63/00*** | (2006.01) |
| ***A63B 69/34*** | (2006.01) |
| *A63B 102/14* | (2015.01) |

(Continued)

(52) U.S. Cl.

CPC ..... *A63B 63/06* (2013.01); *A63B 63/004* (2013.01); *A63B 69/00* (2013.01); *A63B 69/34* (2013.01); *A63B 59/20* (2015.10); *A63B 2063/065* (2013.01); *A63B 2071/0694* (2013.01); *A63B 2102/14* (2015.10)

(58) Field of Classification Search

CPC ..... A63B 69/00; A63B 69/34

USPC ..... 473/446, 513, 443; 4/455; 248/181.1; 269/309, 375, 73, 75; 273/108.56, 359; 403/71, 77; 482/87

See application file for complete search history.

(56) References Cited

U.S. PATENT DOCUMENTS 1,369,707 A * 2/1921 Reilly ..... B23Q 1/545 269/75

1,981,253 A * 11/1934 Schulz ..... B23Q 1/545 248/101

(Continued)

OTHER PUBLICATIONS

Webpage download, Amazon2010 , 2010, www.amazon.com/Mylec-Mini-Goalie-Hockey-Buddy/dp/B000LGZVSE/, 2 pages.*

(Continued)

*Primary Examiner* — Gene Kim
*Assistant Examiner* — M Chambers
(74) *Attorney, Agent, or Firm* — Crawford Maunu PLLC

(57) ABSTRACT

The disclosure is directed to a rotatable life size cut out of a lacrosse goalie target made of plastic, foam rubber, or other material, and preferably a foam rubber, adapted to absorb the shock of repeated impacts of lacrosse balls, holding a lacrosse stick. The target is placed in front of (and optionally attached to by a coupler) a goal net to assist lacrosse players in their practice sessions. The practice goalie can be disposed in a first orientation holding a lacrosse stick such that the net of the lacrosse stick is to the right of the practice goalie's head or in a second orientation wherein the lacrosse stick is to the left of the practice goalies head, and can preferably be rotated to any angle therebetween the first and second configurations. Players can use either positioned practice goalie to practice their shooting using both of their hands.

5 Claims, 5 Drawing Sheets

(51) Int. Cl.
*A63B 71/06* (2006.01)
*A63B 59/20* (2015.01)

(56) References Cited

U.S. PATENT DOCUMENTS

| | | | | | |
|---|---|---|---|---|---|
| 3,765,675 | A * | 10/1973 | DiMarzio | A63B 63/06 | 273/126 A |
| 3,840,228 | A * | 10/1974 | Greaney | A63B 63/00 | 273/127 B |
| 4,168,062 | A | 9/1979 | McCarthy et al. | | |
| 4,489,940 | A * | 12/1984 | Amundson | A63B 69/34 | 473/435 |
| 5,776,019 | A * | 7/1998 | Kronenberger | A63B 63/06 | 273/354 |
| D413,949 | S | 9/1999 | Oudemool et al. | | |
| 6,736,739 | B1 * | 5/2004 | Epworth | A63B 63/004 | 473/443 |
| 6,796,914 | B2 | 9/2004 | Berdugo et al. | | |
| 7,156,760 | B2 | 1/2007 | Berdugo et al. | | |
| D539,373 | S * | 3/2007 | Cook | D21/781 | |
| 2014/0011612 | A1 | 1/2014 | Trombley | | |
| 2015/0190693 | A1 * | 7/2015 | Gilman | A63B 63/06 | 473/446 |

OTHER PUBLICATIONS

Webpage download, Victorystore2013 , 2013, www.victorystore.com/dek-hockey-practice-goalie.html, 3 pages.*
Webpage download, gilmangear2016, 2016, www. store.nexternal.com/gilmangear/practice-goalie-with-trolley-mechanism-p623, 1 page.*

* cited by examiner

PRACTICE GOALIE

RELATED APPLICATIONS

This application claims priority to U.S. Provisional Application No. 61/925,499, filed Jan. 9, 2014, the disclosure and teachings of which are incorporated herein by reference.

FIELD OF THE DISCLOSURE

The present disclosure relates to sports equipment used in the sport of Lacrosse.

BACKGROUND OF THE DISCLOSURE

Lacrosse is a contact team sport which utilizes a small rubber ball and a long-handled stick called a crosse or lacrosse stick. Lacrosse can be played by both men and women and all versions of the game require players to wear padding such as shoulder pads, gloves, helmets, elbow pads, cup, and sometimes rib guards. Some players wear protective face masks. The objective of the game is for a player to score by shooting the ball into an opponent's goal. The lacrosse stick is used to catch, carry, and pass the ball. Other players must keep the opposing team from scoring and attempt to gain the ball through the use of stick checking or poke checking (a defensive technique where a player uses his stick to stop an opposing player), body contact or positioning.

Lacrosse can be played by a team of varying numbers, each carrying a lacrosse stick. Most teams have at least one attack or attack man, one defender or defenseman and at least one midfielder. Attackers are players who are located on the offensive side of the field and focus on scoring. Defenders are players who stay on the defensive side of the field. Defenders focus on blocking an opponent's shot and work in conjunction with their team goalie. Midfielders are the players who play offense and defense and must be able to score against a goalie and run back to the middle of the field to play defense. There is one goalie for each team. The goalie is located in and outside the goal. Their main purpose is to try to stop opponents from scoring.

Accordingly, there exists a need for a practice device which can assist all lacrosse players in becoming more effective scorers of lacrosse balls against a goalie.

SUMMARY OF THE DISCLOSURE

The disclosure provides a life size cut out of a lacrosse goalie holding a lacrosse stick which is rotatably attached to the front upper support of a goal net to assist lacrosse players in their practice sessions. Lacrosse players can practice scoring against the practice goalie. In a first orientation, the practice goalie has the appearance of holding a lacrosse stick such that the net of the lacrosse stick is to the right of the practice goalie's head. In a second configuration, the goalie can be rotated about its coupling 180 degrees to flip it around such that the net of the practice goalie's head is on the other side of the practice goalie's head. Players who are either right handed and/or left handed can use the practice goalie in either rotatable orientation to practice their shooting using both of their hands.

DETAILED DESCRIPTION OF THE DRAWINGS

Figure 1:
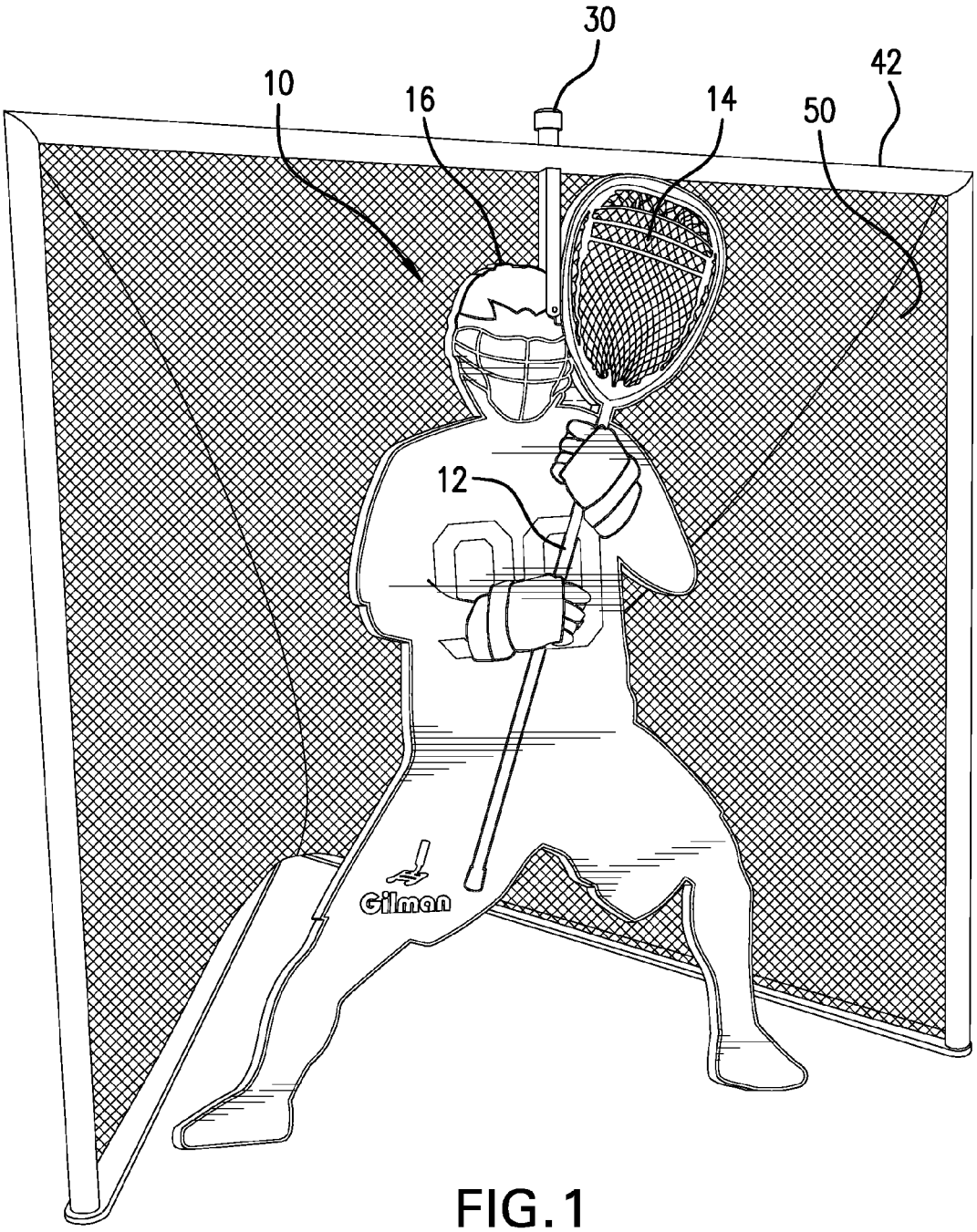
FIG. 1 illustrates an exemplary practice goalie in a first orientation with respect to a goal net.
Figure 2:
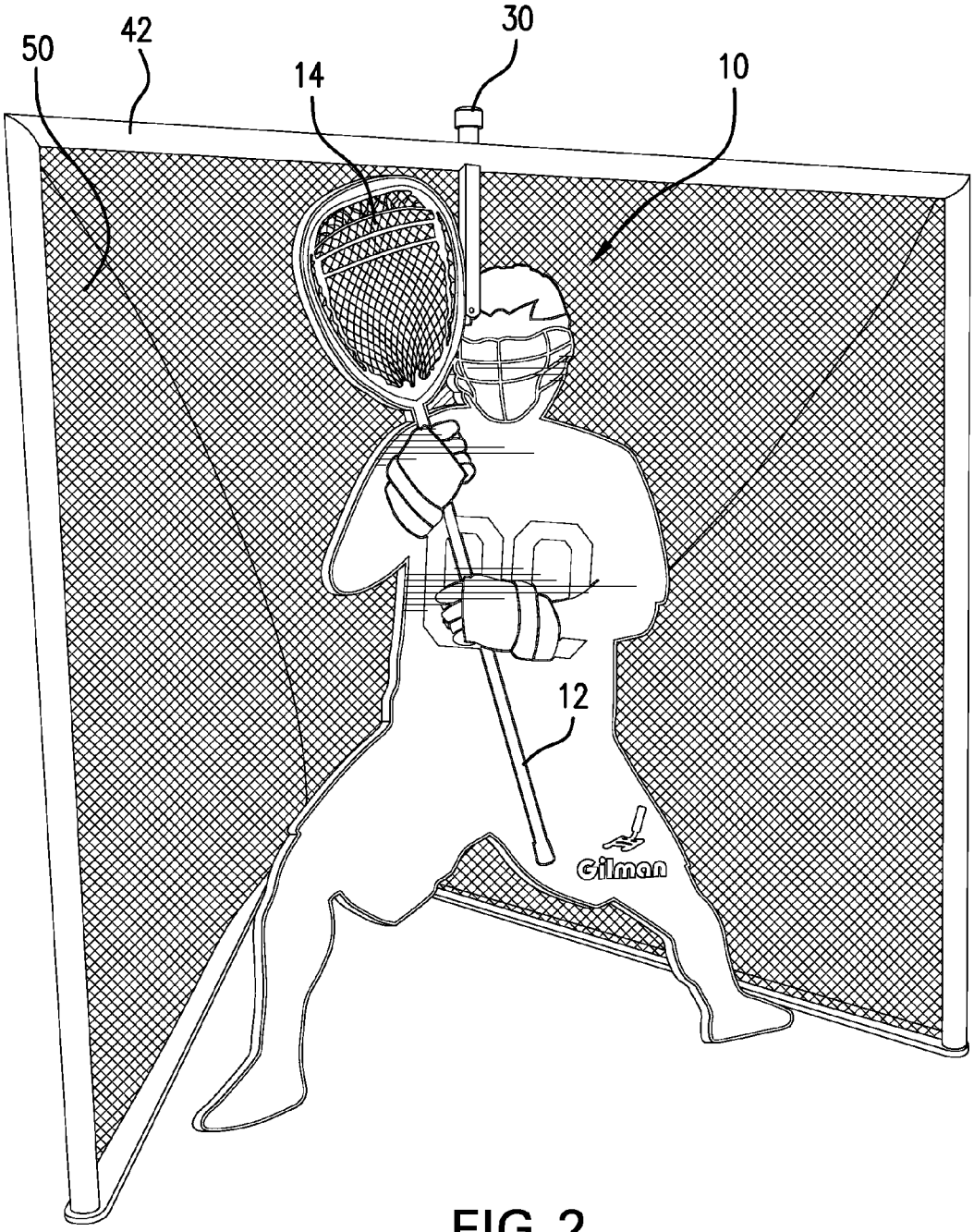
FIG. 2 illustrates the practice goalie in a second orientation rotated 180 degrees with respect to the first orientation.

FIG. 1 of the present disclosure shows an exemplary embodiment of a practice lacrosse goalie target 10 holding a lacrosse stick 12 wherein the net 14 of the lacrosse stick 12 is to the right of the goalie's head 16. FIG. 2 of the present disclosure shows the embodiment of FIG. 1, rotated about a coupling 30 at the upper support 42 (where the goalie target 10 is attached to a structural member 40 of the net 50) so that a mirror image of the goalie 10 is presented with the net 14 of the lacrosse stick 12 to the left of the goalie's head 16.

The cut out version of the practice goalie, shaped like a lacrosse player, can be of varying sizes to match players of all ages and sizes. The practice goalie, having a body portion and a lacrosse stick portion extending upwardly therefrom, preferably has a height of approximately sixty-two to seventy-two inches. The cut out version is placed in front of, and attached to, a structural member 40 of a goal net 50 to assist lacrosse players in their practice sessions. The attachment can be a simple clamp arrangement (not shown in the Figures) that grabs the upper support 42 of the goal net 50 that is disconnected and contains a coupling 30 to permit the goalie 10 to be rotated 180 degrees and reattached to obtain the opposite orientation.

Figure 3:
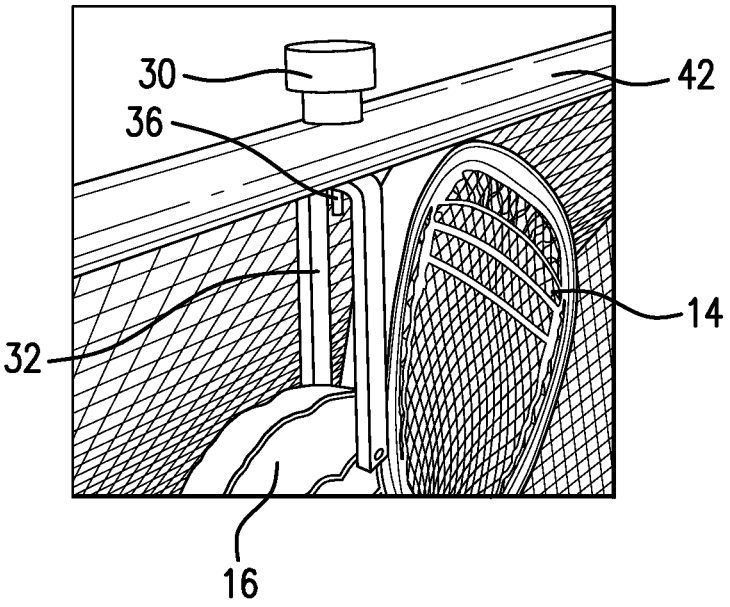
FIG. 3 illustrates a rotatable coupling for mounting the practice goalie to the frame of a lacrosse goal, and for setting the practice goalie at a desired rotational angle with respect to a plane defined by the entrance to the goal.

Alternatively, a rotatable coupling 30 can be used, wherein the goalie 10 can be rotated without unbolting it or unclamping it from the structural member 40 of the net 50, such as the embodiment illustrated in FIG. 3. The practice goalie target 10 can be attached to coupler 30 by means of a vertical connector 32 made of plastic, metal, or a material identical to the practice goalie target, adapted to rotate on a pin or screw 36 without releasing from the coupler 30. This permits the practice goalie 10 to be oriented at any desired oblique angle with respect to the goal net 50, so as to simulate a goalie guarding against an attacker approaching the goal from an oblique angle, such that the goalie can be rotated from 0-45 degrees in one degree increments, for example, with respect to the plane defined by the entrance of the goal. In one embodiment, the rotational coupling 30 can be provided with angular markings to permit setting the practice goalie consistently at a desired angle with respect to the plane defined by the entrance to the goal. As will be appreciated, lacrosse players can thus practice scoring against the practice goalie thereby increasing their effectiveness as a scorer against right handed and left handed goalies.

The practice goalie 10 can be made of various materials such as plastic, rubber or other material. In a preferred embodiment, practice goalie 10 can also be made of a foam rubber or other rubber material that can absorb shots without ricocheting such that a lacrosse ball the impacts the goalie essentially falls to the ground after impact. In one implementation, the goalie can be formed from a closed cell foam rubber sold under the trade name ENSOLITE® in any desired thickness, such as one inch, one and one half inches, two inches, and the like. In a preferred embodiment, the foam is high density Polyvinyl Chloride Nitrile Butadiene Rubber (PVC/NBR). The density of the foam can be selected to be medium or high density, as desired. The image of the goalie can be printed on a substrate, such as a vinyl coated nylon in various weights, such as 7, 8, 9, 10, 11, 12, 13, 14, 15, 16, 17, or 18 oz. per square yard, and then adhered to the foam rubber using various techniques, such as adhesives, double sided tapes and the like. The practice goalie 10 is principally supported by the top rotational mechanism, but in other embodiments can additionally or alternatively supported by a base (not shown in the Figures) that can be weighted or otherwise anchored to the ground. The rotational mechanism allows the practice goalie to be positioned in any angle relative to the front plane of the goal, and allows the practice goalie to be reversible, that is to resemble a right-handed or left-handed goalie. Regardless of materials and base, the practice goalie is configured to withstand multiple lacrosse rubber balls being hurled at it by multiple practicing lacrosse players, simultaneously or in succession. The practice goalie 10 can alternatively be attached to an existing goal by drilling a hole in the top of the lacrosse goal.

The practice goalie target 10 can be positioned so that the target is parallel to the front of the goal 40, at any angle and at the front of the goal net, or such that the goal line is extended into the lacrosse field. Players can practice the art of cutting with the practice goalie. Cutting is where the player cuts toward the goal, while trying to elude oncoming defenders, in order to receive a pass from a teammate and score against the practice goalie. Players can also utilize the practice goal as they practice their feeds, i.e., assists, by passing the ball to an attacker who then shoots against the goalie.

The practice goalie 10 is able to be moved to an outdoor field or used in an indoor facility. The goal can be any suitable goal for supporting the practice goalie, as are known in the industry.

Figure 4:
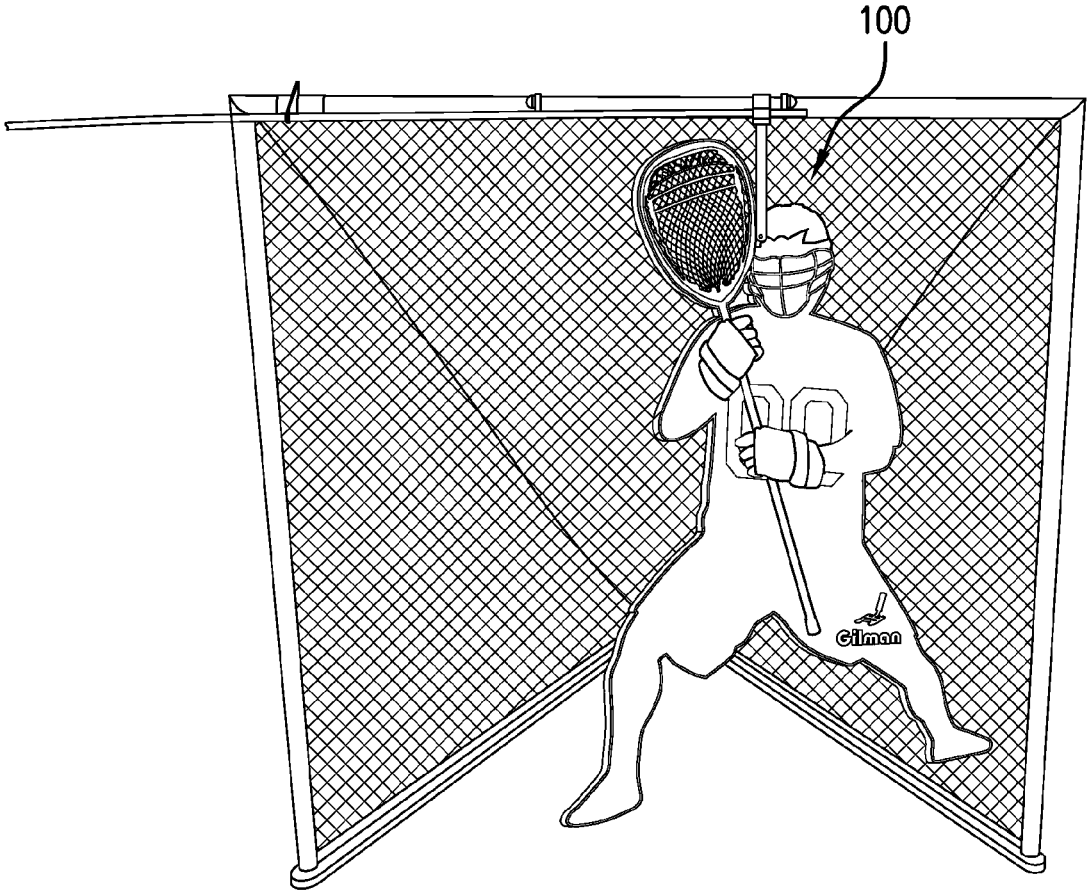
FIG. 4 is a view of a second representative embodiment of a practice goalie in accordance with the disclosure.
Figure 5:
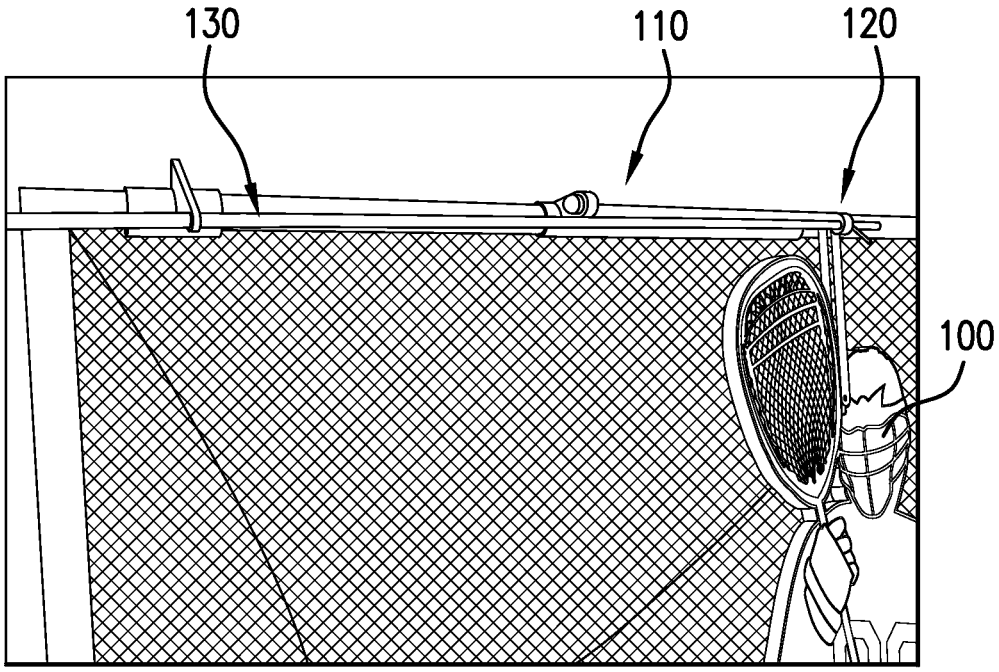
FIG. 5 is a close up view of a portion of the embodiment of FIG. 4.

In an alternative embodiment as set forth in FIGS. 4 and 5, a practice goalie 100 is provided that is mounted on a rotatable coupling that is in turn slidably mounted on a slidable mount 120 that slides and/or rolls along a rail 110. Rail 110 can be, for example, one foot, 1.5 feet or about two feet wide, and supported on each end by a bracket that is attached to the goal. If desired, a control rod 130 attached to the slidable mount to pull or push the goalie back and forth that can be further supported by a slidable mount as depicted in FIG. 5. If desired, instead of a control rod, tethers (not shown) such as ropes can be attached to the mount 120 that extend in opposite directions past the goal, permitting a user on each tether to manipulate the movement of the goalie.

The methods and systems of the disclosed embodiments, as described above and shown in the drawings, provide for equipment and related techniques with superior attributes including, among other things, improved ease of use. It will be apparent to those skilled in the art that various modifications and variations can be made in the devices and methods of the disclosed embodiments without departing from the spirit or scope of the disclosure. Thus, it is intended that the disclosure include modifications and variations that are within the scope of the appended claims and their equivalents.

What is claimed is:

1. A lacrosse goal practice target comprising:

a) an elongate planar body having a top portion, a bottom portion, and two opposing outwardly facing planar sides, the two opposing outwardly facing planar sides being defined by a common perimeter, the perimeter being configured to resemble a full sized planar projection of a lacrosse player holding a lacrosse goaltender stick, the outwardly facing planar sides further defining indicia thereon to further illustrate the lacrosse player, the elongate planar body being composed essentially of a flexible resilient material that is configured to absorb shock of incoming lacrosse balls thrown at the target; and b) a rotatable coupling attached to the top portion of the elongate planar body, the rotatable coupling being configured to attach to a central region of a cross member of a lacrosse goal, the rotatable coupling and elongate planar body being configured to rotate 360 degrees about a vertical axis from the coupling without being removed from the lacrosse goal to permit the outwardly facing planar sides to be oriented at any desired rotational angle with respect to the lacrosse goal, and further wherein the bottom portion of the elongate planar body is unattached to the lacrosse goal and permitted to deflect when impacted by an incoming lacrosse ball to absorb energy from the incoming lacrosse ball c) the coupling further includes a linear adjustment such that the lacrosse goal practice target can be translated along a length of the cross member of the lacrosse goal in addition to being rotated about the vertical axis.

2. A lacrosse goal practice target according to claim 1, wherein the elongate planar body is composed of foam rubber material.

3. A lacrosse goal practice target according to claim 1, wherein the coupler is provided with angular marking indicia configured to inform a user of the angle at which the practice goalie is oriented with respect to the lacrosse goal.

4. A lacrosse goal practice target according to claim 1, wherein the elongate planar body has a lengthwise dimension between sixty-two and seventy-two inches.

5. A lacrosse goal comprising:

a) a perimeter frame including two upright supports attached at an upper end thereof by a cross member, the two upright supports and the cross member defining an entrance plane to the goal;

b) a net attached to the perimeter frame; and c) practice target, including:

i) an elongate planar body having a top portion, a bottom portion, and two opposing outwardly facing planar sides, the two opposing outwardly facing planar sides being defined by a common perimeter, the perimeter being configured to resemble a full sized planar projection of a lacrosse player holding a lacrosse goaltender stick, the outwardly facing planar sides further defining indicia thereon to further illustrate the lacrosse player, the elongate planar body being composed essentially of a flexible resilient material that is configured to absorb shock of incoming lacrosse balls thrown at the target; and ii) a rotatable coupling attached to the top portion of the elongate planar body, the rotatable coupling being configured to attach to a central region of the cross member of the lacrosse goal, the rotatable coupling and elongate planar body being configured to rotate 360 degrees about a vertical axis from the coupling without being removed from the lacrosse goal to permit the outwardly facing planar sides to be oriented at any desired rotational angle with respect to the entrance plane of the lacrosse goal, and further wherein the bottom portion of the elongate planar body is unattached to the lacrosse goal and permitted to deflect when impacted by an incoming lacrosse ball to absorb energy from the incoming lacrosse ball iii) the coupling further includes a linear adjustment such that the lacrosse goal practice target can be translated along a length of the cross member of the lacrosse goal in addition to being rotated about the vertical axis.

* * * * *